United States Patent [19]

McManus et al.

[11] Patent Number: 4,535,552

[45] Date of Patent: Aug. 20, 1985

[54] SPAGHETTI DRYER

[75] Inventors: Gregory K. McManus, San Mateo; Masato Otani, Hayward, both of Calif.

[73] Assignee: Microdry Corporation, San Ramon, Calif.

[21] Appl. No.: 493,996

[22] Filed: May 12, 1983

[51] Int. Cl.[3] ..... F26B 19/00

[52] U.S. Cl. ..... 34/236; 34/63; 34/156; 198/473; 198/625; 198/663; 198/631; 426/242

[58] Field of Search ..... 34/1, 68, 156, 236; 198/473, 580, 681, 472, 608, 625, 663; 426/242

[56] References Cited

U.S. PATENT DOCUMENTS

| | | | |
|---|---|---|---|
| 155,285 | 9/1874 | Brook | 198/681 |
| 1,565,849 | 12/1925 | Durand, Jr. | 198/625 |
| 2,583,847 | 1/1952 | Hummel | 198/681 |
| 2,813,498 | 11/1957 | Senzani | 198/681 |
| 2,953,360 | 9/1960 | Kline | 198/580 |
| 3,133,727 | 5/1964 | Luscombe | 198/608 |
| 3,308,930 | 3/1967 | Francisci | 198/625 |
| 3,313,398 | 4/1967 | Andrews | 198/663 |
| 3,340,991 | 9/1967 | Bontempi et al. | 198/681 |
| 3,511,356 | 5/1970 | Bilocq | 198/625 |
| 3,718,480 | 2/1973 | Tremblay et al. | 426/242 |
| 3,908,029 | 9/1975 | Fredrickson | 426/557 |
| 4,382,403 | 5/1983 | Tokayer | 198/473 |

FOREIGN PATENT DOCUMENTS

| | | | |
|---|---|---|---|
| 882074 | 7/1953 | Fed. Rep. of Germany | 198/663 |
| 2504896 | 11/1982 | France | 198/625 |
| 45078 | 4/1979 | Japan | 198/625 |

*Primary Examiner*—Edward G. Favors
*Assistant Examiner*—Steven E. Warner
*Attorney, Agent, or Firm*—Edmond T. Patnaude

[57] ABSTRACT

Wet and pliable strands of freshly extruded spaghetti are draped over horizontally disposed rods whose respective ends rest in helical grooves in a first pair of mutually parallel, rotating shafts which carry the rods and the spaghetti through a drying oven, the rods being transferred to helical grooves in a second pair of mutually parallel, rotating shafts which carry the rods and spaghetti through the oven in a direction transverse to the direction in which they are carried by the first pair of shafts.

13 Claims, 13 Drawing Figures

SPAGHETTI DRYER

The present invention relates in general to apparatus for transporting products through a processing station, and it relates in particular to a new and improved method and means for carrying freshly extruded spaghetti or the like through a drying oven. The invention also relates to a new and improved spaghetti dryer.

BACKGROUND OF THE INVENTION

When manufacturing spaghetti on a commercial basis, the common practice has been to drape strands of wet spaghetti over long, straight sticks or rods and to support the ends of the sticks on spaced parallel conveyor chains which carry the sticks in mutually parallel relationship through an oven. Preferably, the sticks have been carried in a horizontal direction through the top portion of the oven then lowered a distance greater than the length of the spaghetti, and then carried in a horizontal direction back across the oven. After several such passes, the spaghetti has been dried and the sticks and the spaghetti move out of the oven.

In the past, the sticks were lowered from one pair of horizontal chains to the next by means of vertically disposed chains having spaced attachments on which the ends of the sticks rested. The vertical and horizontal chains were synchronized, but for several reasons, improper stick placement and dropping of the sticks from the chains was not uncommon particularly during the transfer of the sticks from one set of conveyor chains to the next. The sticks were not held in a positive manner wherefor food or other material which could be inadvertently deposited on the sticks could result in the sticks moving too slowly during the transfer from one conveyor to the next with the result that the sticks would jam up and the spaghetti hanging from one stick would then interfere with the movement of the next adjacent stick.

Spaghetti dryers preferably include at least one compartment wherein the spaghetti is heated by microwave energy, and it is important that any leakage of microwave energy from that compartment be minimized. Consequently, it has been the practice to move the sticks and the spaghetti which hangs thereon into and out of the microwave treatment compartment through a narrow slot in the top wall of that compartment. Since the strands of spaghetti tend to flare out at the bottom and also to swing back and forth on the sticks, the entrance and exit slots were necessarily wider than the bottom widths of the bundles of spaghetti hanging on the sticks. Inasmuch as leakage of microwave energy is a function of the size of the entrance and exit openings, it would be desirable to reduce the size of these openings and thus improve the microwave trapping characteristics thereof.

SUMMARY OF THE INVENTION

Briefly, there is provided in accordance with the present invention a system for transporting a plurality of sticks or rods in parallel, spaced relationship through a processing station, which system utilizes a pair of spaced apart, helically grooved rotating shafts on which the ends of the rods are supported to carry spaghetti or other products through the space between the shafts with the outer portions of the sticks resting in the grooves in the respective shafts.

In accordance with an important feature of the invention, the rods are transferred from the helical grooves of a first pair of horizontally disposed shafts to a pair of helically grooved, vertically disposed parallel shafts which lift the rods to a second pair of horizontally disposed shafts vertically spaced from the first pair of horizontal shafts. During the transfer between the vertical and horizontal shafts, the rods are positively retained wherefor they cannot be accidentally dropped.

In a spaghetti dryer embodying the invention, the rods enter the oven near the bottom and are lifted from one processing station to the next wherefor the entrance and exit slots to the microwave oven are substantially narrower than would be required if the entrance slot were at the top and the spaghetti was lowered through it down into the microwave oven and then lowered through an exit slot at the bottom of the microwave oven.

GENERAL DESCRIPTION OF THE DRAWINGS

The present invention will be better understood by a reading of the following detailed description taken in connection with the accompanying drawings wherein.

DETAILED DESCRIPTION OF PREFERRED EMBODIMENTS OF THE INVENTION

Referring to FIGS. 1–4, there is shown an automated oven 20 for drying spaghetti during the manufacture thereof. While the invention is described in connection with this particular application, it will be understood by those skilled in the art that the invention has other applications where a product is to be passed through a processing or treatment area. Moreover, as used herein the term, spaghetti, is intended to describe any thin, elongated pasta or other product which may be draped over sticks or rods prior to its being treated.

The oven 20 may be relatively large, having a length of, for example, thirty feet, a height of eighteen feet and a width of nine feet, it being understood, however, that the size of the oven is not critical inasmuch as the invention may be used in substantially larger or smaller systems.

Figure 1:
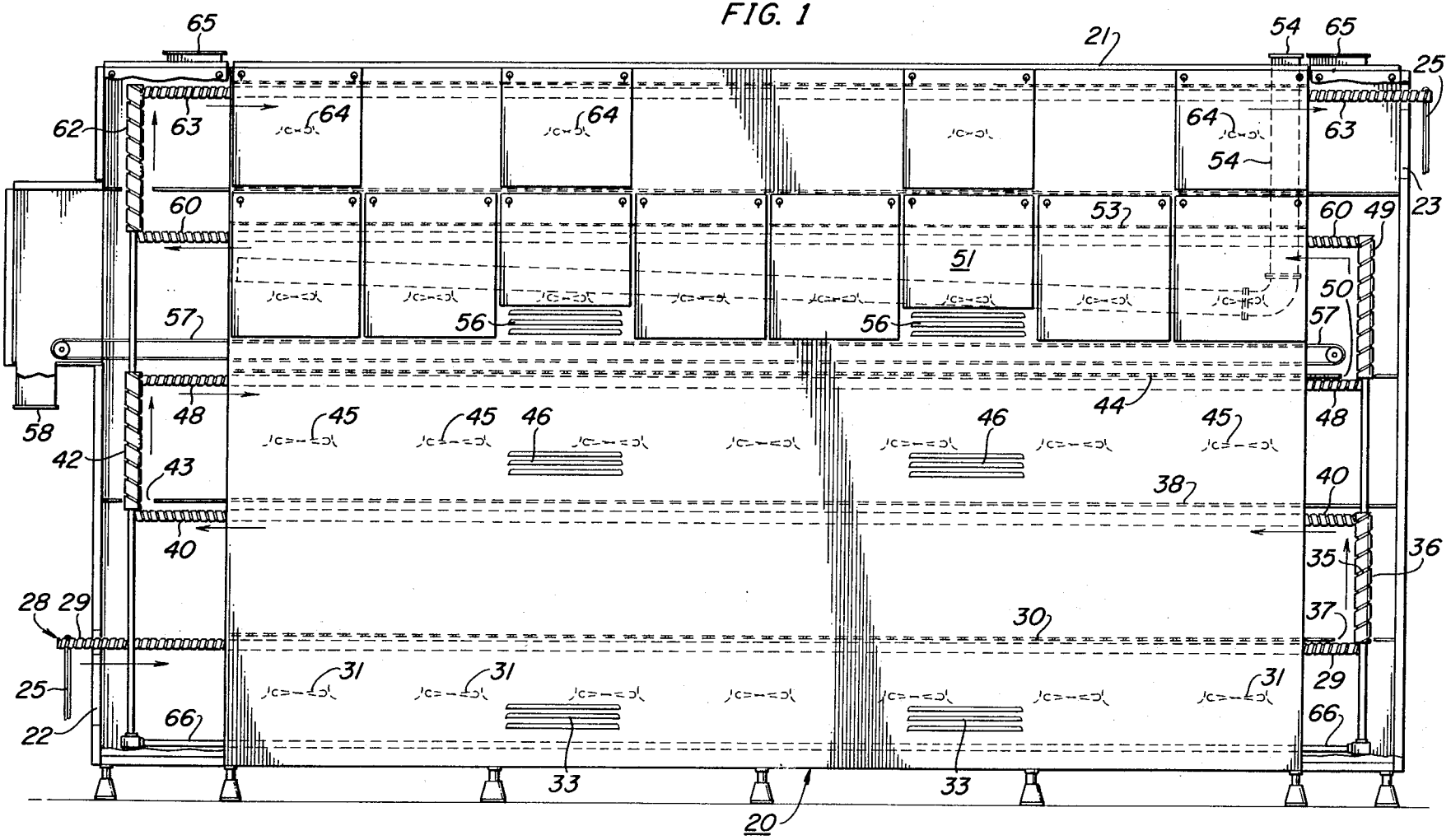
FIG. 1 is a side elevational view of processing apparatus particularly suited for drying spaghetti.

As shown, the oven 20 includes an enclosure 21 having a plurality of removable access panels or doors and windows. A product inlet opening 22 is provided near the bottom of the left hand side of the oven as it is shown in FIG. 1 and a product discharge opening 23 is provided near the top of the right hand side of the oven as it is shown in FIG. 1. The product passes through a plurality of treating stations or zones located one above the other within the oven before emerging through the the discharge opening 23. The product first travels in a horizontal direction from left to right through the first station along the bottom of the oven and is then elevated to the next station through which it travels in a horizontal direction back across the oven from right to left. In a similar manner the product is carried through each of the other subsequent treating stations or zones in the oven.

Figure 4:
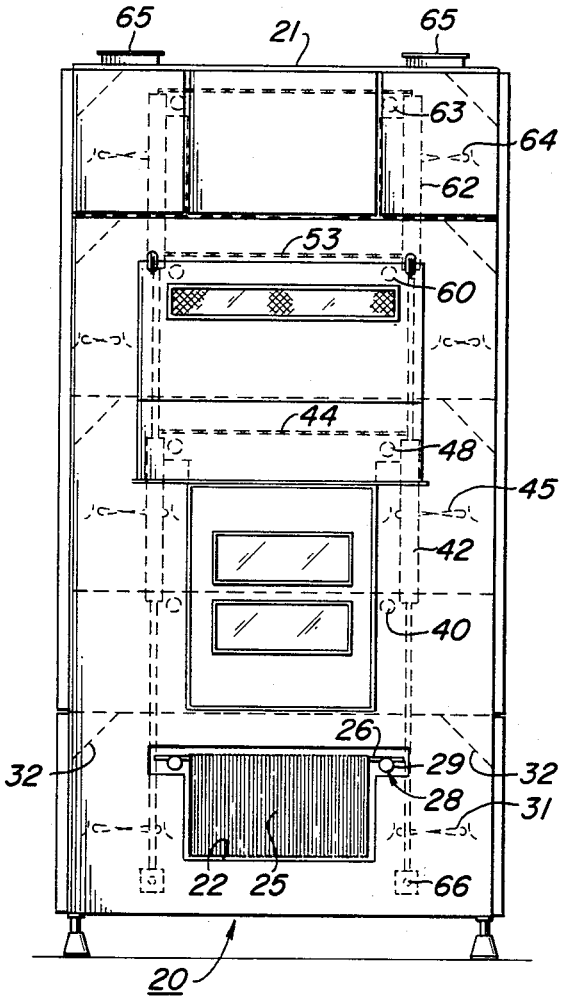
FIG. 4 is an elevational view of the apparatus of FIG. 1 taken from the left-hand side thereof.
Figure 2:
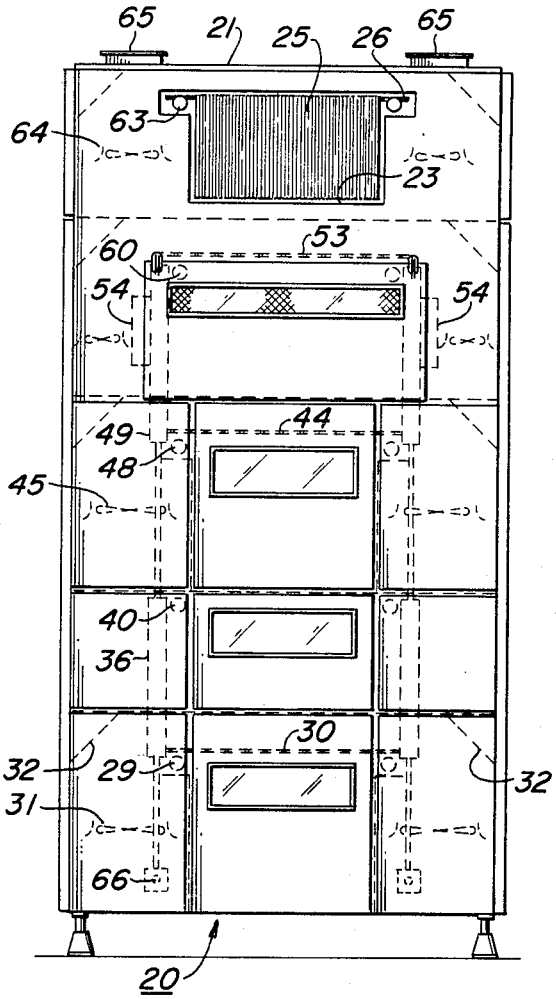
FIG. 2 is an elevational view of the apparatus of FIG. 1 taken from the right-hand side thereof.

The oven 20 is particularly designed for drying spaghetti, and as may be seen in FIGS. 1, 2 and 4, the individual strands of spaghetti 25 are draped over the intermediate portions of elongated sticks or rods 26 which may have a length, for example, of about four feet. As the individual strands 25 are extruded from other equipment, not shown, they are hung over the rods 26, then cut to equal length, and the rods are then placed on a pair of conveyor shafts 28 which are suitably journaled in spaced apart, parallel relationship in the oven. The shafts 28 extend out of the left-hand end of the oven where the rods are placed about one and one-half inches apart in helical grooves 29 provided in the shafts 28. The grooves 29 in the respective shafts 28 are mirror images of one another and the shafts are driven in synchronism so as to move the sticks across the oven.

A perforate wall 30 extends horizontally across the oven a short distance above the conveyor shafts 28, and hot air is introduced into the compartment below the wall 30 for predrying the spaghetti as it passed through this compartment. The heated air is circulated within the predrier compartment by means of a plurality of blowers 31 and by diagonally disposed baffles 32 (FIGS. 2 and 4) which direct the air down onto the spaghetti. As shown, a plurality of louvered air vents 33 are provided in the front and rear walls of the oven.

As the rods approach the right hand end of the oven they are transferred to helical grooves 35 in a pair of vertical conveyor shafts 36 which intercept the outer ends of the rods and lift them through an opening 37 in the wall 30 into a second compartment located between the wall 30 and a horizontal imperforate wall or partition 38. The rods are then transferred from the vertical conveyor shafts 36 to a second pair of helically grooved, horizontal conveyor shafts 40 which carry the rods and the spaghetti hanging therefrom from right to left through the second compartment. There is no appreciable circulation of air within the second compartment. The second stage in the drying process is commonly called a "sweat" stage inasmuch as the internal moisture in the spaghetti propagates to the surface as the spaghetti moves through the second compartment. When the rods reach the left-hand end of the oven they are transferred from the shafts 40 to a pair of helically grooved, vertical conveyor shafts 42 which lift them vertically through an opening 43 in the wall 38 into a third processing compartment located between the wall 38 and a perforated wall or partition 44. This latter compartment constitutes a second predrier stage wherein heated air is circulated by a plurality of blowers 45. As in the first predrier stages, the front and rear exterior walls of the oven are provided with a plurality of louvered air vents 46. A pair of helically grooved, horizontal conveyor shafts 48 extend in parallel relationship across the top of the second predrier stage compartment. The rods 26 are transferred from the vertical shafts 42 to the horizontal shafts 48 and are carried from left to right through the second predrier stage and then transferred to a pair of helically grooved, vertical conveyor shafts 49 through a slotted opening 50 in the wall 44 into a microwave drying compartment 51.

The microwave compartment 51 is located between the lower wall 44 and a perforated top wall or partition 53. Microwave energy is supplied to the compartment 51 by means of a pair of rectangular waveguides 54 which are slotted along their lengths to permit the energy transmitted therethrough to be radiated into the compartment 51 in the well known manner. A plurality of blowers 55 are provided to circulate the air within the microwave compartment. Also louvered air vents 56 are provided in the front and rear walls of the oven.

A pair of helically grooved conveyor shafts 60 receive the rods from the vertical shafts 49 and carry them from right to left through the microwave compartment 51 to a pair of helically grooved vertical conveyor shafts 62 which lift them and the spaghetti up through an exit slot in the wall 53 into an equalizer stage compartment located between the wall 53 and the top of the oven. The rods are then transferred to a pair of helically grooved, horizontal shafts 63 which are disposed a short distance below the top of the oven and extend from the left-hand end thereof out through the discharge opening 23 at the right.

The horizontal and vertical conveyor shafts are continuously driven in synchronism by a suitable motor connected to a common drive shaft 66. The shaft 66 is suitably connected by other shafts and gear sets to the respective conveyor shafts.

The horizontal conveyor shafts on each side of the oven are substantially identical as are the vertical conveyor shafts, and the shafts, in each pair are driven in opposite directions.

In order to prevent the spaghetti which hangs from one rod from contacting the following rod as the first rod is elevated from one pair of horizontal conveyor shafts to the next, the rods must be moved upwardly at a speed which is much greater than their horizontal speed, unless of course, the spacing between adjacent sticks exceeds the vertical dimension of the spaghetti hanging from the sticks. As previously stated, the sticks are closely spaced for efficient operation of the oven 20. Consequently, the helical grooves in the vertical conveyor shafts have a much greater pitch than that of the helical grooves in the horizontal conveyor shafts and the vertical shafts are rotated at a greater r.p.m. than are the horizontal shafts. If desired, the vertical conveyor shafts can be driven at a much higher r.p.m. than that of the horizontal conveyor shafts and the grooves on all of the shafts can have the same pitch to obtain the same result.

In accordance with an important aspect of the present invention, the rods are held in a captured state as they are transferred between the grooves of the horizontal and vertical conveyor shafts. Also, the rods are held in a positive manner in the grooves of the vertical conveyor shafts as they are moved from one set of horizontal conveyor shafts to the next, and where desirable to do so, retainer bars or the like may be used to prevent the rods from raising up out of the grooves in the horizontal conveyor shafts.

Although it is particularly desirable in the drying of spaghetti to locate the processing compartments one above the other and to lift the spaghetti from one compartment to the next to permit the use of smaller size entrance and exit openings, particularly to and from the microwave heating compartment, the conveyor system of the present invention may be used to carry product through successively lower process stations.

Figure 5:
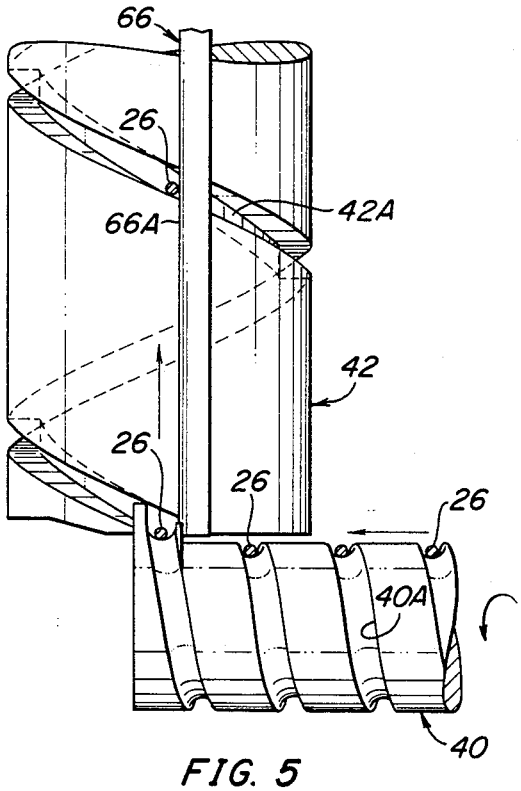
FIG. 5 is an elevational view of a system for moving rods and the like from a pair of helically grooved horizontal shafts to a pair of helically grooved vertical shafts.

Referring to FIG. 5, there is shown the transfer means employed in the oven 20 of FIG. 1 to transfer the rods from the grooves of the horizontal conveyor shafts 40 to the grooves of the associated vertical conveyor shafts 42. It will be understood by those skilled in the art that the same transfer system may be used for transferring the rods from the other horizontal conveyor shafts to the other associated vertical conveyor shafts.

The horizontal shaft 40 has a single helical groove 40A in which the rods 26 are adapted to rest and move from right to left as the shaft 40 rotates counterclockwise as viewed from the right-hand side as shown in FIG. 5. The two end portions of the rods 26 extend a short distance beyond the shafts 40 so as to move into the helical grooves 42A in the vertical shafts 42. The shaft 42, as viewed in FIG. 5, rotates in a clockwise direction so that the rods travel upwardly along the edge 66A of a backup bar 66. As the rods 26 move to the left, they pass beneath the bottom end of the bar 66 and are lifted by the raised portion of the groove 40A at the end of the shaft 40 against the edge 66A of the bar 66. The rods 26 are then engaged by the bottom side of the groove 42A and are lifted up along the edge 66A as shown in FIG. 5.

Figure 6:
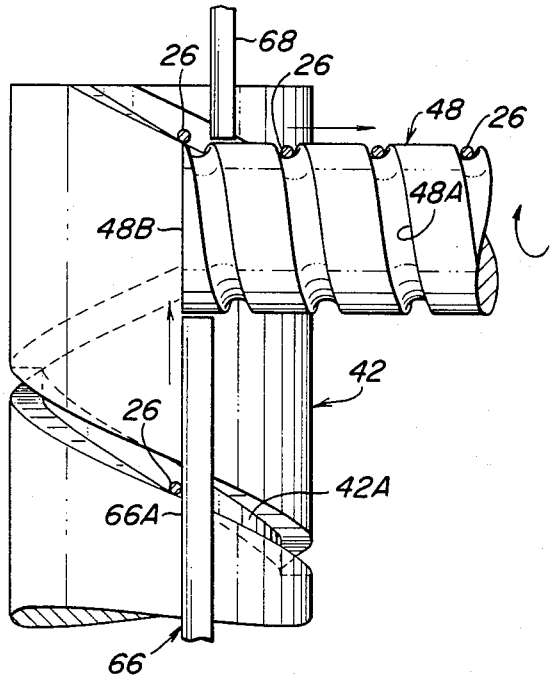
FIG. 6 is an enlarged fragmentary view of a system for moving rods from a pair of helically grooved vertical shafts to a pair of helically grooved vertical shafts.

Referring to FIG. 6, it may be seen that the left-hand end 48B of the shaft 48 is planar and flush with the edge 66A of the backup bar 66. Consequently, the rods 26 move up along the edge 66A, then along the end surface 48B and over the top of the shaft 48 where they move into the helical groove 48A therein. The shaft 48 is rotated in a clockwise direction as viewed in FIG. 6 and it and its associated shaft thus carry the rods 26 under a hold down element 68 and across the oven.

It may thus be seen that during the transfer the rods 26 are positively held in the grooves in either the horizontal or vertical shafts at all times. As a result, the rods 26 cannot be accidentally dropped and, moreover, they move smoothly through the system wherefor undue swinging of the spaghetti is avoided.

Figure 7:
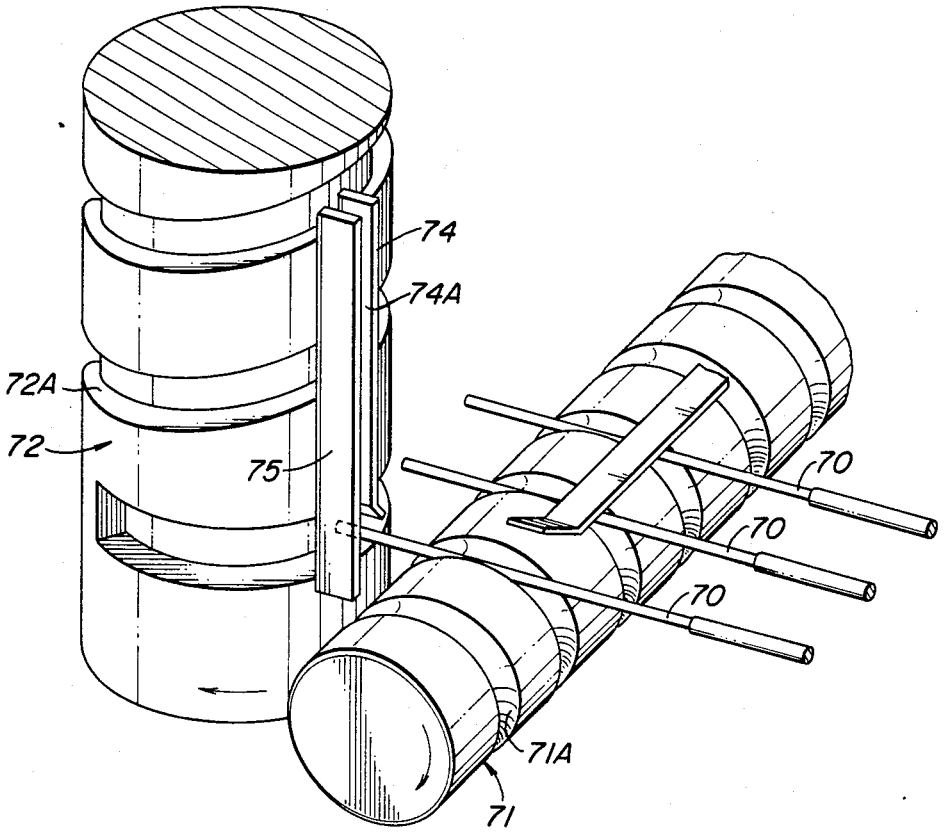
FIG. 7 is a fragmentary perspective view showing another system for transferring rods from helically grooved horizontal shafts to helically grooved vertical shafts.

Referring to FIG. 7 there is shown another transfer means for transferring spaghetti-carrying rods 70 from the helical groove 71A in one of a pair of horizontal conveyor shafts 71 to the helical groove 72A in one of a pair of vertical conveyor shafts 72. The shafts 71 and 72 rotate in the directions indicateed by the arrows and the shaft 72 rotates at a much greater r.p.m. than does the shaft 71 so that each rod is lifted to the top of the shaft 72 before the next rod moves into the bottom of the groove 72A. The ends of the rods 70 move seriatem under the offturned lower end of a backoff bar 74 which extends alongside the shaft 72 in parallel relationship therewith. The shafts 71 and 72 are synchornized so that shortly after the rods move under the bar 74 and into the groove 72A they are engaged by the bottom surface of the groove 72A and lifted up along the surface 74A. A stop bar 75 is spaced from and extends parallel to bar 74 to hold the rods 70 against excessive movement in the groove 72A before they are engaged by the bottom surface of the groove. Preferably, and as shown, the lower end portion of the groove 72A is substantially horizontal so as to gradually lift the rods and smoothly accelerate them after they are transferred to the groove 72A. As in the embodiment of the invention shown in FIG. 5, the rods are captured in either the groove 71A or the groove 72A during the transfer process whereby the rods 70 cannot be accidentally dropped.

Figure 8:
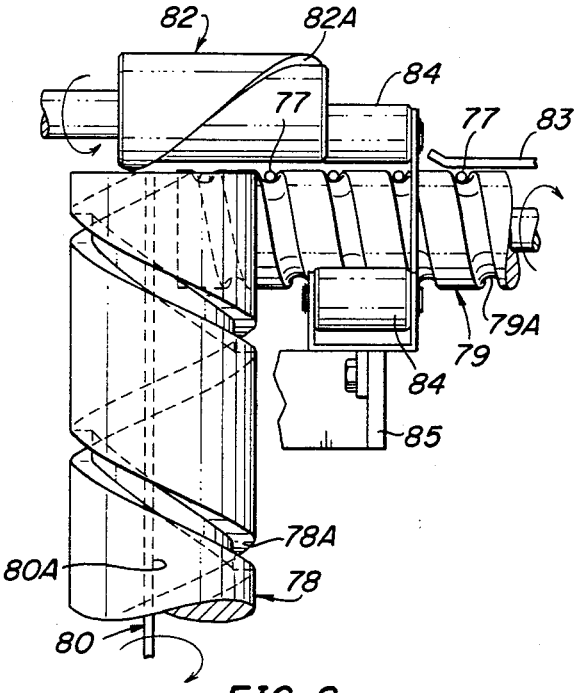
FIG. 8 is an elevational view showing another transfer means for transferring rods from the helical grooves of a pair of vertical shafts to the helical grooves of a pair of horizontal shafts.
Figure 9:
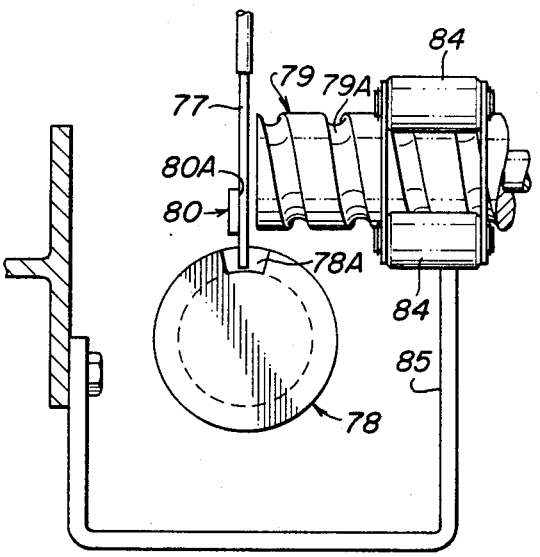
FIG. 9 is an elevational view of the transfer means of FIG. 8 taken from the right hand side thereof.

Referring now to FIGS. 8 and 9 there is shown another transfer means for transferring spaghetti carrier sticks or rods 77 from the helical groove 78A of a vertical conveyor shaft 78 to the helical groove 79A of a horizontal conveyor shaft 79. In this embodiment of the invention the ends of the sticks 77 are disposed on the groove 78A and move up along the edge 80A of a guide bar 80 until they reach the top of the bar 80 and are moved above it onto the top end of the shaft 78. They are then pushed to the right as shown in FIG. 8 by a rotating cam 82 having a generally spiral camming surface 82A which pushes the stick located at the top of the shaft 78 to the right over the shaft 79 where it is pushed down into the groove 79A and carried to the right under a guide bar 83 which extends across the top of the shaft 79 in spaced, parallel relationship therewith. As shown, the shaft 79 is journaled between a plurality of freely rotatable rollers 84 carried by a suitable bracket 85. The cam 82 is driven in synchronism with the shafts 78 and 79 and preferably by the same power source.

Figure 11:
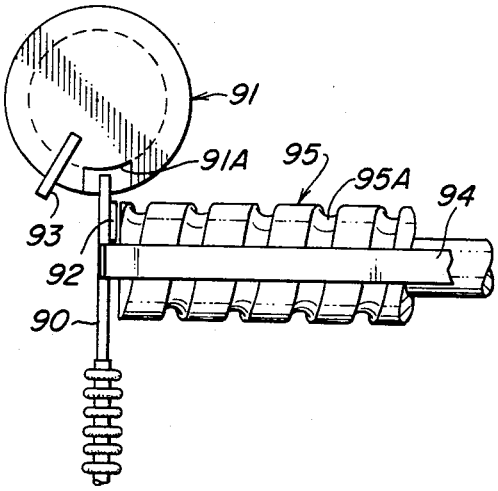
FIG. 11 is a top view of the transfer means of FIG. 10.
Figure 10:
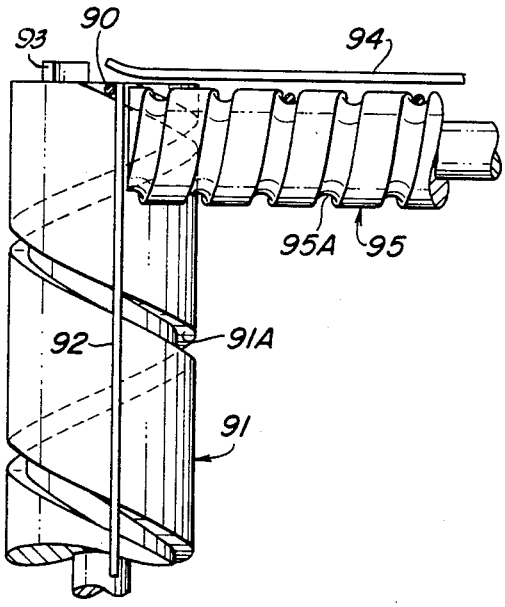
FIG. 10 is an elevational view of another transfer means for transferring rods from the helical grooves of vertical shafts to the helical grooves of horizontal shafts.

Referring to FIGS. 10 and 11 there is shown still another transfer means for transferring sticks or rods from the vertical conveyor shafts to the horizontal conveyor shafts. As there shown, as the sticks 90 reach the top of the helical groove 91A in a vertical conveyor shaft 91 they are lifted over the upper end of a backup bar 92. A radial tab 93 which extends upwardly from the top end of the shaft 91 then sweeps the stick 90 under a guide bar 94 and over the end portion of a horizontal conveyor shaft 95 where it is picked up by the end portion of the helical groove 95A in the shaft 95 and carried to the right as viewed in FIGS. 10 and 11.

It may thus be seen that the present invention provides for the transfer of rods or sticks and a product carried by them through a drying oven or other treating zone. In the illustrated spaghetti dryer the rods are carried by means of pairs of helically grooved shafts whereby to be maintained in mutually parallel relationship at all times, and in a preferred embodiment of the invention they are carried back and forth through a plurality of treating compartments.

Figure 3:
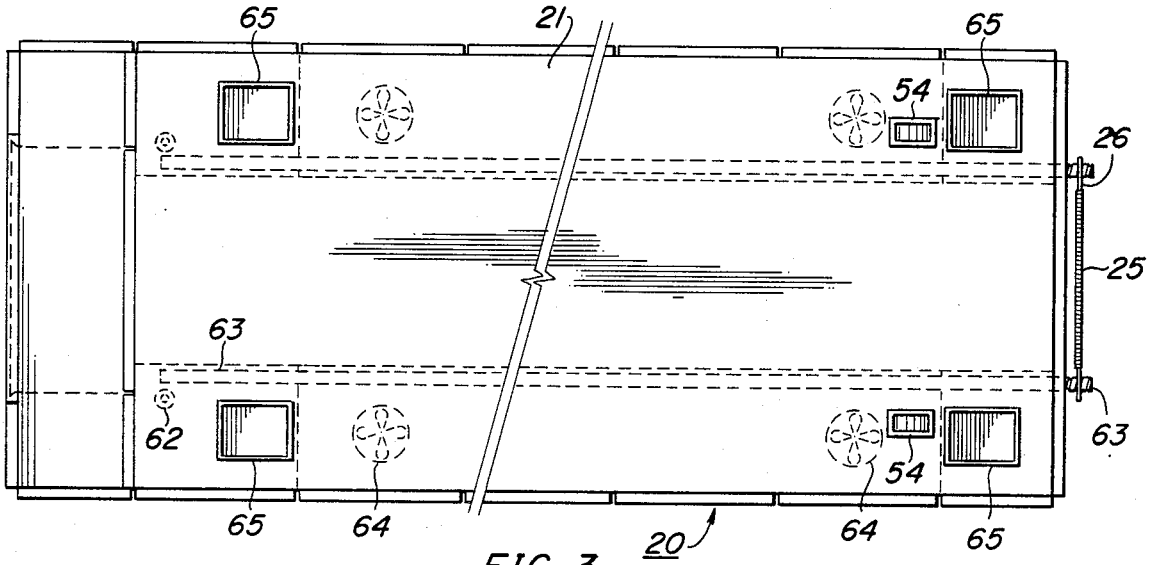
FIG. 3 is a top view of the apparatus of FIG. 1A.
Figure 13:
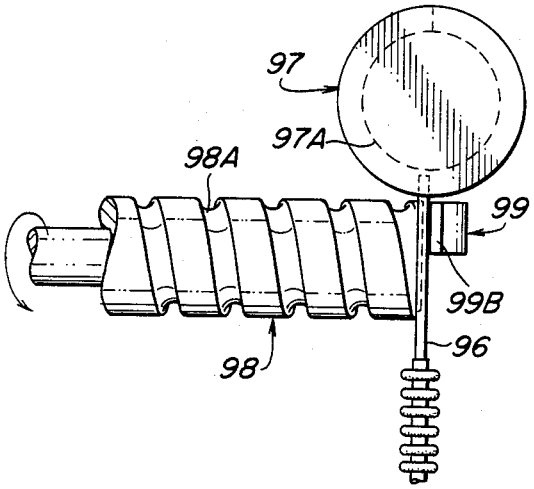
FIG. 13 is a top view of the transfer means of FIG. 12.
Figure 12:
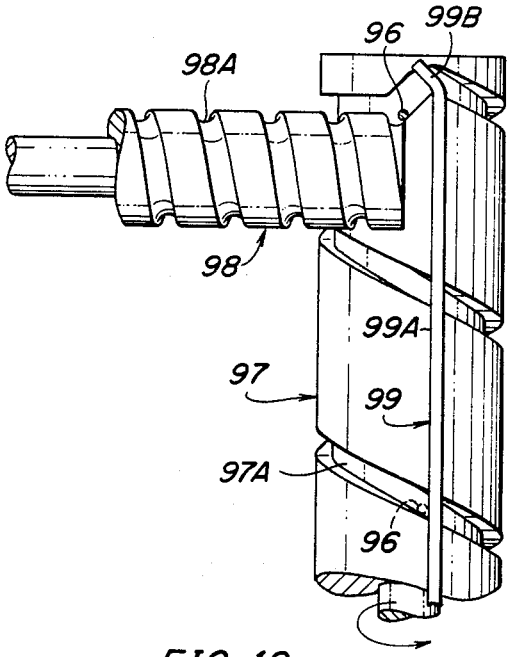
FIG. 12 is an elevational view of still another transfer means for transferring rods from the helical grooves of a pair of vertical shafts to the helical grooves of a pair of horizontal shafts.

Referring to FIGS. 12 and 13 there is shown another transfer means for transferring product support sticks or rods 96 from the helical groove 97A of a vertical conveyor shaft 97 to the helical groove 98A of a horizontal conveyor shaft 98. As the sticks 96 move up along the edge 99A of the backup bar 99 they move up past the end of the shaft 98 and are moved toward the shaft 98 by the offturned end 99B of the bar 99. The groove 97A has a reverse turn at the top which causes the sticks 96 to move down onto the top of the shaft 98 where they are picked up by the end of the groove 98A and carried to the left as shown in FIGS. 2 and 3.

In the embodiments of the invention which have been particularly shown and described, the product moves horizontally through the treating compartments and is lifted from one compartment to the next by means of pairs of helically grooved vertical shafts. The shafts in each pair are driven at the same speed with all of the pairs of conveyor shafts being driven in synchroism and preferably by the same drive motor. The rods are maintained in a captured state during their transfer from one pair of shafts to the next pair of shafts to prevent accidental dropping of the rods, and they are positively moved from the helical grooves of one pair of shafts to the helical grooves of the next pair of shafts to prevent the rods from jamming up in the transfer mechanism.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. In combination, a drying oven, a first pair of spaced apart, parallel shafts respectively having an external, generally helical groove therein, said first pair of shafts extending in a vertical direction, a plurality of rods each having spaced apart portions respectively located in said grooves, drive means for rotating said shafts in synchronism to move said rods in a direction parallel to said shafts through said oven, a second pair of spaced apart, parallel shafts respectively having an external groove therein, said second pair of shafts being horizontally disposed, transfer means for transferring said rods from the grooves of one of said pairs of shafts to the grooves of the other of said pair of shafts during the transfer thereof from one of said pairs to the other, said rods being simultaneously located in said grooves of both of said pairs of shafts during the transfer thereof from one of said pairs to the other, the shafts in said one of said pair of shafts extend in proximity to the shafts in said other of said pair of shafts, and the end portions of said grooves adjacent said vertical shafts in said second pair of shafts having an increasing base diameter to lift said rods into the lower ends of the grooves in said vertically disposed shafts.

2. The combination according to claim 1 comprising retainer means extending parallel to said shafts and respectively positioned in proximity to said shafts for retaining said rods in said grooves.

3. In combination, a drying oven, a first pair of spaced apart, parallel shafts respectively having an external, generally helical groove therein, said first pair of shafts extending in a vertical direction, a plurality of rods each having spaced apart portions respectively located in said grooves, drive means for rotating said shafts in synchronism to move said rods in a direction parallel to said shafts through said oven, retainer means extending parallel to said shafts and respectively positioned in proximity to said shafts for retaining said rods in said grooves, a second pair of spaced apart, parallel shafts respectively having an external groove therein, said second pair of shafts being horizontally disposed, transfer means for transferring said rods from the grooves of one of said pairs of shafts to the grooves of the other of said pair of shafts during the transfer thereof from one of said pairs to the other, said rods being simultaneously located in said grooves of both of said pairs of shafts during the transfer thereof from one of said pairs to the other, said retainer means each including an elongated vertical surface along which said rods move upwardly as said vertically disposed shafts are rotated, the ends of said second pair of shafts being flat and coplanar with said vertical surfaces and adjacent thereto, and second retainer means extending parallel to said vertically disposed shafts above said second pair of shafts, said second retainer means each including a surface spaced inwardly from the end of said second pair of shafts to permit said rods to move from the grooves in said vertically disposed shafts into the grooves in said horizontally disposed shafts.

4. In combination, a drying oven, a first pair of spaced apart, parallel shafts respectively having an external, generally helical groove therein, said first pair of shafts extending in a vertical direction, a plurality of rods each having spaced apart portions respectively located in said grooves, drive means for rotating said shafts in synchronism to move said rods in a direction parallel to said shafts through said oven, a second pair of spaced apart, parallel shafts respectively having an external groove therein, said second pair of shafts being horizontally disposed, transfer means for transferring said rods from the grooves of one of said pairs of shafts to the grooves of the other of said pair of shafts during the transfer thereof from one of said pairs to the other, said rods being simultaneously located in said grooves of both of said pairs of shafts during the transfer thereof from one of said pairs to the other, said horizontally disposed shafts extending in proximity to said vertically disposed shafts, and backup means extending parallel to said vertically disposed shafts and positioned to intercept said rods carried by said horizontally disposed shafts and to prevent further horizontal movement of said rods by said horizontally disposed shafts.

5. The combination according to claim 4 wherein the bottoms of said grooves in said vertically disposed shafts are substantially horizontal at the location where said walls initially engage said rods after they are moved by said horizontal shafts against said backup means.

6. In combination, a drying oven, a first pair of spaced apart, parallel shafts respectively having an external, generally helical groove therein, said first pair of shafts extending in a vertical direction, a plurality of rods each having spaced apart portions respectively located in said grooves, drive means for rotating said shafts in synchronism to move said rods in a direction parallel to said shafts through said oven, a second pair of spaced apart, parallel shafts respectively having an external groove therein, said second pair of shafts being horizontally disposed, transfer means for transferring said rods from the grooves of one of said pairs of shafts to the grooves of the other of said pair of shafts during the transfer thereof from one of said pairs to the other, said rods being simultaneously located in said grooves of both of said pairs of shafts during the transfer thereof from one of said pairs to the other, and said transfer means comprising rotatable cam means disposed above said vertically disposed shafts for urging said rods across the end surfaces of said vertically disposed shafts into said grooves of said pair of horizontally disposed shafts.

7. In combination, a drying oven, a first pair of spaced apart, parallel shafts respectively having an external, generally helical groove therein, said first pair of shafts extending in a vertical direction, a plurality of rods each having spaced apart portions respectively located in said grooves, drive means for rotating said shafts in synchronism to move said rods in a direction parallel to said shafts through said oven, a second pair of spaced apart, parallel shafts respectively having an external groove therein, said second pair of shafts being horizontally disposed, transfer means for transferring said rods from the grooves of one of said pairs of shafts to the grooves of the other of said pair of shafts during the transfer thereof from one of said pairs to the other, said rods being simultaneously located in said grooves of both of said pairs of shafts during the transfer thereof from one of said pairs to the other, and said transfer means comprising radially extending surfaces respectively extending from the tops of said vertically disposed shafts, said grooves in said vertically disposed shafts opening onto the tops of said vertically disposed shafts.

8. In combination, a drying oven, a first pair of spaced apart, parallel shafts respectively having an external, generally helical groove therein, said first pair of shafts extending in a vertical direction, a plurality of rods each having spaced apart portions respectively located in said grooves, drive means for rotating said shafts in synchronism to move said rods in a direction parallel to said shafts through said oven, a second pair of spaced apart, parallel shafts respectively having an external groove therein, said second pair of shafts being horizontally disposed, transfer means for transferring said rods from the grooves of one of said pairs of shafts to the grooves of the other of said pair of shafts during the transfer thereof from one of said pairs to the other, said rods being simultaneously located in said grooves of both of said pairs of shafts during the transfer thereof from one of said pairs to the other, and the grooves in said vertically disposed shafts each having a reverse turn at the respective ends thereof adjacent said horizontally disposed shafts for moving said rods downwardly into the grooves in said horizontal shafts.

9. Apparatus for drying spaghetti, comprising a plurality of rods over which a plurality of strands of wet spaghetti are adapted to be hung, an oven, a first pair of horizontal shafts disposed in said oven and respectively having external spiral grooves for receiving said rods, a plurality of said rods being disposed in said grooves and supported by said shafts, means for rotating said shafts in mutual synchronous relationship to cause said rods to move horizontally through said oven, a first pair of vertical shafts disposed in said oven in proximity to the ends of said first pair of shafts and respectively having external spiral grooves for receiving said rods, means for rotating said vertical shafts in mutual synchronous relationship to cause one of said rods disposed in the respective grooves of said vertical shafts to move in a vertical direction in said oven, means for transferring said rods seriatem from the grooves of said horizontal shafts to the grooves of said vertical shafts, a second pair of horizontal shafts disposed in said oven and respectively having external spiral grooves for receiving said rods, means for rotating said second pair of shafts in mutual synchronous relationship to cause rods disposed in said grooves to move horizontally through said oven, and means for transferring said rods seriatem from the grooves of said vertical shafts to the grooves of said second pair of horizontal shafts.

10. Apparatus according to claim 9 wherein said second pair of horizontal shafts are disposed above said first pair of horizontal shafts.

11. Apparatus according to claim 10 comprising a first horizontally extending compartment in which said first pair of horizontal shafts are disposed, a second, horizontally extending compartment in which said second pair of horizontal shafts are disposed, and means for radiating microwave energy into said second compartment.

12. Apparatus according to claim 11 comprising a horizontal, metallic partition separating said first compartment from said second compartment, and said partition having a narrow slot through which said rods are lifted by said vertical shafts from said first compartment into said second compartment.

13. Apparatus according to claim 9 wherein said first pair of horizontal shafts is disposed above said second pair of horizontal shafts, and further comprising a first compartment in which said first pair of horizontal shafts is disposed, a second compartment in which said second pair of horizontal shafts is disposed, a horizontal, metallic partition separating said first compartment from said second compartment, means for radiating microwave energy into said second compartment, and said partition having a narrow slot through which said rods are lifted by said vertical shafts from said second pair of horizontal shafts to said first pair of horizontal shafts.

* * * * *